US008344639B1

(12) United States Patent
Bahrehmand

(10) Patent No.: US 8,344,639 B1
(45) Date of Patent: Jan. 1, 2013

(54) PROGRAMMABLE LED DRIVER

(76) Inventor: Farhad Bahrehmand, Seven Hills, OH (US)

( * ) Notice: Subject to any disclaimer, the term of this patent is extended or adjusted under 35 U.S.C. 154(b) by 274 days.

(21) Appl. No.: 12/697,280

(22) Filed: Jan. 31, 2010

Related U.S. Application Data

(63) Continuation-in-part of application No. 12/324,200, filed on Nov. 26, 2008.

(51) Int. Cl.
*H05B 41/16* (2006.01)

(52) U.S. Cl. ..... 315/247; 315/294; 315/307

(58) Field of Classification Search ..... 315/185 R, 315/291, 294, 307, 312, 360, 362
See application file for complete search history.

(56) References Cited

U.S. PATENT DOCUMENTS

| | | | | |
|---|---|---|---|---|
| 5,357,566 | A | 10/1994 | Dowling, Jr. et al. | |
| 5,920,309 | A | 7/1999 | Bisset et al. | |
| 6,940,733 | B2 | 9/2005 | Schie et al. | |
| 7,145,295 | B1 | 12/2006 | Lee et al. | |
| 7,242,393 | B2 * | 7/2007 | Caldwell | 345/173 |
| 7,609,008 | B1 * | 10/2009 | Kohler | 315/307 |
| 2003/0137258 | A1 * | 7/2003 | Piepgras et al. | 315/291 |
| 2003/0227375 | A1 | 12/2003 | Yong | |
| 2004/0212321 | A1 | 10/2004 | Lys et al. | |
| 2006/0113975 | A1 | 6/2006 | Mednik et al. | |
| 2007/0124362 | A1 | 5/2007 | Chung et al. | |
| 2008/0285271 | A1 * | 11/2008 | Roberge et al. | 362/235 |
| 2010/0052577 | A1 * | 3/2010 | Brownlee | 315/362 |
| 2011/0018465 | A1 * | 1/2011 | Ashdown | 315/294 |

OTHER PUBLICATIONS

Supertex Product Dat Sheet HV9910—Universal High Brightness LED Driver—parent U.S. Appl. No. 128/234,200.
Supertex Product Data Sheet HV9910B—"Universal High Brightness LED Driver"—parent U.S. Appl. No. 12/234,200.
National Semiconductor Data Sheet LM555—parent U.S. Appl. No. 12/234,200.
CTS Technical Data sheet "Series 270"—parent U.S. Appl. No. 12/234,200.
Texas Instruments Data Sheet MSP430F1121—Mixed Signal Microcontroller—parent U.S. Appl. No. 12/234,200.
Supertex Application Data sheet AN-H48—"Buck-based LED Driver using the HV9910B"—parent U.S. Appl. No. 12/234,200.

* cited by examiner

*Primary Examiner* — Tung X Le

(57) ABSTRACT

The present invention resides in an LED driver that comprises an LED driver circuit adapted to receive a 110V AC current and to rectify said current into a low voltage rectified DC output current. The driver comprises a programmable integrated circuit (PIC), means operatively connecting said programmable integrated circuit with said LED driver circuit, a capacitive touch pad sensor comprising a plurality of touch pads, a capacitive touch pad sensor IC circuit (SIC) that scans one or more of the touch pads and provides corresponding data to said programmable integrated circuit, said programmable integrated circuit being programmable to accept said data as input and generate an output signal to said LED driver circuit corresponding to said data, one or more of said touch pads functioning for dimming such that said programmable integrated circuit generates a fixed frequency PWM signals having an adjustable duty cycle for dimming said LEDs. Preferably the touch pad for dimming is a touch slider. Preferably the LED driver is adapted to fit within a standard 110 volt AC outlet box, said touch pad sensor being the faceplate of said outlet box.

10 Claims, 3 Drawing Sheets

PROGRAMMABLE LED DRIVER

RELATED APPLICATIONS

This application is a continuation-in-part of and claims the benefit of co-pending application Ser. No. 12/324,200, filed Nov. 26, 2008, titled "LED Driver and Integrated Dimmer and Switch". This application also claims the benefit of U.S. Provisional Application Ser. No. 61/207,152 filed Feb. 9, 2009 titled "Programmable LED Driver" and the filing date thereof. The disclosures of the aforementioned Pending and Provisional Applications are hereby incorporated herein in their entirety by reference hereto.

BACKGROUND OF THE INVENTION

1. Technical Field

The present invention relates to an LED driver for an array of light emitting diodes (LED's), and more specifically to an LED driver that is programmable. The driver comprises a programmable integrated circuit such as a microprocessor. The driver is designed to fit within a standard 110 volt AC outlet. The faceplate for the driver is a touch sensing device by which the driver is enabled to perform multiple functions including dimming, random on/off and timed on/off.

2. Description of Prior Art

LED is abbreviation of "Light Emitting Diode", which is a small electronic device that lights up when an electric current is passed through it. The term diode refers to a family of two-pin semiconductor devices. The current can pass through them only in one direction. The first LED's were red. They were introduced to the market decades ago. The early red LED's quickly found applications as tiny indicators on audio equipment, TV's, and even digital wrist watches. Later, LED's were used as seven-segment display modules, and the first pocket calculators used them. Years of research has introduced all sorts of colorful LED's to the market. The most common LED's are red, green, yellow, blue, and orange. The color of LED is due to the material used in the LED chip not just the color of the package. In the past several years, the LED market has seen a big jump in the brightness of the LED's, and white LED's have been introduced that produce enough light that they have been used in cars and general lighting.

The main advantages of LED's are long life span (some exceeding 100,000 hours), and high efficiency compared to small tungsten or incandescent lights. Additionally, they generate very little heat when they are operated at the rated current. They can also take a harsh environment, as there is no filament in them. The disadvantages (at least when compared to 110V tungsten light bulbs) are that they can not directly replace incandescent lamps, and, a single LED is very small and cannot generate enough light to light up a room. Therefore, the LED's for generating a large amount of light are used in clusters. Some designers used them in series strings, some use them in parallel strings, and some use them in a combination of series and parallel strings.

The LED's are normally used in constant-current circuits. The early LED's required only 10 milliamperes to operate. Many new ultra-bright white LED arrays require a current of 750 milliamperes to operate at maximum brightness.

The term "LED driver" refers to any kind of electronic circuit that produces the current and voltage necessary to turn on a specific LED or cluster of LED's. For example, some LED drivers can take as input the 12VDC from a car battery, and generate enough current to turn on a combo cluster of 20 LED's used in a tail light. Another example is an LED driver that turns on a combo of LED clusters used as the backlighting for flat panel LCD displays (the LED's have effectively replaced fluorescent back lighting).

The LED driver for commercial and residential lighting is different because the input voltage is 110 volts AC. This voltage needs to be converted to DC and also it needs to be regulated such that it does not feed more than the necessary amount of current to the LED's. If the LED's are driven by higher currents and voltage than their rated values, their life span will significantly shorten or they may even burn out quickly.

Currently, lighting fixture companies use LED drivers for fixtures such as chandeliers that are so large they can barely fit into the ceiling or fixture canopy. The drivers also do not have any onboard or external dimmer. It has been proposed to use a conventional incandescent 110 volt AC dimmer for dimming LED's. This is an awkward way of solving the problem because two units have to be installed, one in the ceiling and one in the wall outlet for the fixture. In addition, there are compatibility issues between LED drivers and incandescent dimmers.

Published US application 2004/0212321 discloses an LED driver configured to provide power from an Ac 110 volt circuit to a plurality of LED's. The driver gets its power from rectified standard AC voltage. Further, a conventional AC dimmer is used for dimming functionality.

Published US application 2006/0113975 discloses controlling output current of a DC/DC converter. While this circuit could be employed in an LED driver, it does not disclose the technology of the present invention.

U.S. Pat. No. 6,940,733 discloses a power supply using a frequency modulated pulse train for optimal power conversion. The circuitry of the present invention employs a fixed frequency.

U.S. Pat. No. 7,145,295 discloses a simple design for controlling light emitting diodes. While this design could be used for dimming LED's, it does not disclose a technology as how to power, dim, and switch LED's on/off in an offline application that could also be fit in an AC outlet for lighting applications.

Published Data Sheet HV9910 titled "Universal High Brightness LED Driver" by Supertex, Inc, 1235 Bordeaux Drive, Sunnyvale, Calif., 94089, discloses a PWM high efficiency LED driver control IC. It allows efficient operation of High Brightness (HB) LED's from voltage sources ranging from 8VDC up to 450VDC. The HV9910 controls an external MOSFET at fixed switching frequency up to 300 kHz. The frequency can be programmed using a single resistor. The LED string is driven at constant current rather than constant voltage, thus providing constant light output and enhanced reliability. The output current can be programmed between a few milliamps and up to more than 1.0 A. The HV9910 uses a rugged high voltage junction isolated process that can withstand an input voltage surge of up to 450V. Output current to an LED string can be programmed to any value between zero and its maximum value by applying an external control voltage at the linear dimming control input of the HV9910. The HV9910 provides a low-frequency PWM dimming input that can accept an external control signal with a duty ratio of 0-100% and a frequency of up to a few kilohertz.

It is known to combine a microprocessor with a touch sensor to perform certain functions. For instance, U.S. Pat. No. 5,357,566 discloses a programmable telephone dialing device that employs a microcontroller activated by a touch sensor. Published patent application Number 2007/0124632 discloses a touch sensing device for sensing electricity signals of an object. U.S. Pat. No. 5,920,309 discloses a capacitive touchpad that transmits signals to a microcontroller. In published application Number 2003/022737, a microcontroller selects a text message corresponding to a particular touch sensor signal and transmits it to a display screen. This is accompanied by an audible signal that provides the operator with positive feedback indicating selection of the correct message.

SUMMARY OF THE INVENTION

The present invention resides in an LED driver that comprises an LED driver circuit adapted to receive a 110V AC current and to rectify said current into a low voltage rectified DC output current. The driver comprises a programmable integrated circuit (PIC), means operatively connecting said programmable integrated circuit with said LED driver circuit, a capacitive touch pad sensor comprising a plurality of touch pads, a capacitive touch pad sensor IC circuit (SIC) that scans one or more of the touch pads and provides corresponding data to said programmable integrated circuit, said programmable integrated circuit being programmable to accept said data as input and generate an output signal to said LED driver circuit corresponding to said data, one or more of said touch pads functioning for dimming such that said programmable integrated circuit generates a fixed frequency PWM signals having an adjustable duty cycle for dimming said LEDs.

Preferably the touch pad for dimming is a touch slider.

Preferably the LED driver is adapted to fit within a standard 110 volt AC outlet box, said touch pad sensor being the faceplate of said outlet box.

Preferably, one or more of said touch pads is used for timed on/off function such that said programmable integrated circuit enables/disables the PWM signal to automatically turn on/off said LED's; and one or more of said touch pads is used for random on/off function such that said programmable integrated circuit randomly enables/disables said PWM signal to randomly turn on/off said LED's with seed numbers and codes for random number generation burned into the programmable integrated circuit.

Examples of programmable integrated circuits (PICs) useful in the present invention are a microcontroller, a field programmable gate array (FPGA), and an application specific integrated circuit (ASIC). A microcontroller or a field programmable gate array (FPGA) can be programmed by the user of the present invention

BRIEF DESCRIPTION OF THE DRAWINGS

The present invention and advantages thereof will become more apparent from reference to the following detailed description with reference to the accompanying drawings, in which.

DETAILED DESCRIPTION OF THE PRESENT INVENTION

Figure 1:
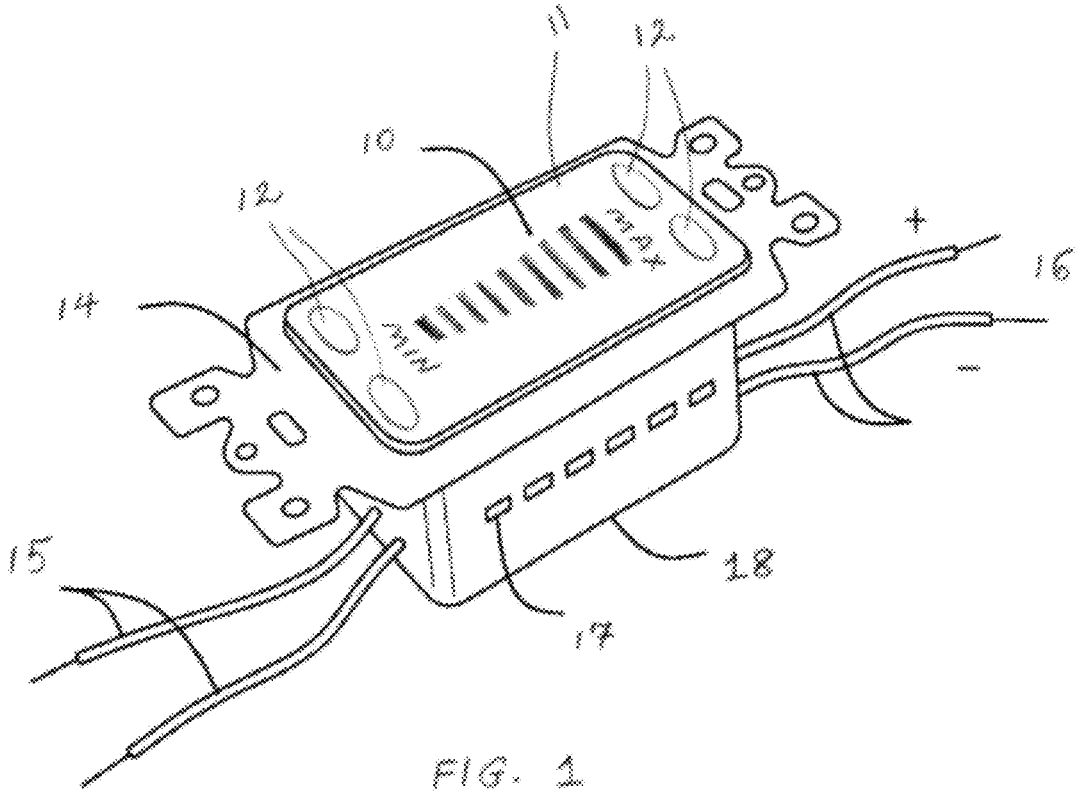
FIG. 1 is a perspective view of a programmable LED driver according to the present invention.

FIG. 1 provides an overview of the present invention using an integrated capacitive touch pad sensing technology as the user interface.

An enclosure 18 houses all the components of the invention and is small enough to fit into a standard AC outlet box. The enclosure 18 is made of a code approved material, and is attached to a mounting bracket 14. The mounting bracket 14 secures the assembly onto a standard AC outlet using two or more screws (not shown). The mounting bracket 14 is made of a thin metal, such as aluminum, such that it can be grounded for safety (grounding wire not shown).

The enclosure 18 comprises a touch pad sensor 8 having a face plate 11. The face plate 11 functions as the face plate for the AC outlet box. Touch pad sensors are well known. All the functions of the present invention are operated by one or more capacitive touch sensitive pads 10 and 12 (shown in phantom lines) positioned underneath the face plate 11. Capacitive touch pads 10 have been arranged to form a touch slider to control the brightness level of LED's and to turn the LED's on/off, in a manner to be described. The touch slider 10 is preferably located beneath the center of the faceplate 11 for easy access. One or more touch sensitive pads 12 are used to activate a timer for scheduled on/off of the LEDs, and to activate random on/off of the LEDs. Additional touch pad sensors could be employed to program other desired tasks, but the critical tasks are dimming, timed or scheduled on/off and random on/off.

The leads 15 connect to 110VAC power line. The leads 16 are DC output leads that connect to one or more or an array of LED's. Openings 17 permit air circulation for cooling the components in the enclosure 18. It is important to note that since the touch sensitive pads 10 and 12 are located underneath the faceplate 11, there is no wire or conductor situated on the faceplate 11. This provides a very safe, reliable operation even in the harshest environments such as areas where explosive gases could be in the vicinity, or outdoor outlets which are exposed to rain, snow, and frost.

Figure 2:
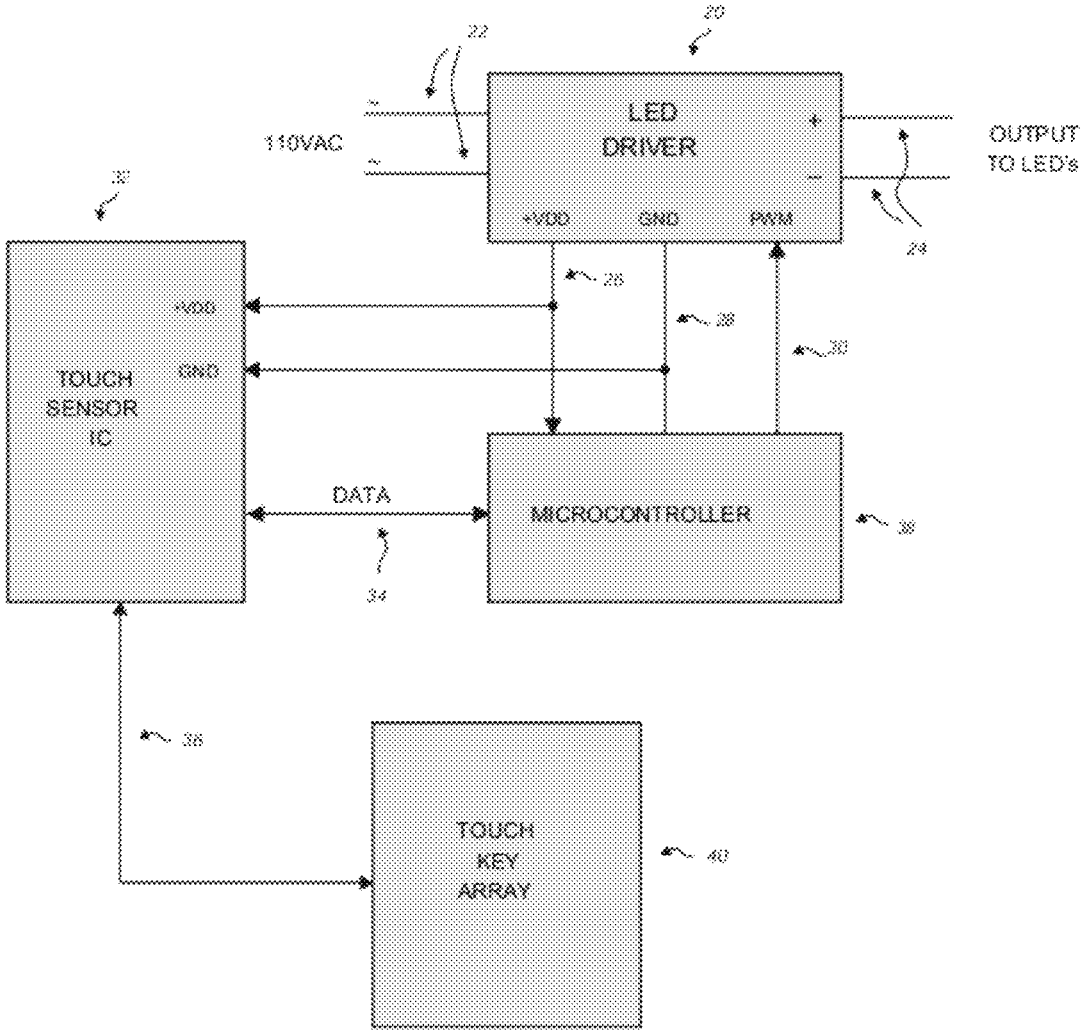
FIG. 2 is a schematic illustration showing the circuitry of the programmable LED driver of FIG. 1.

FIG. 2 is a block diagram of a PWM generator in accordance with the present invention. A touch pad array 40 communicates with a capacitive touch pad sensor IC circuit 32 via data interface lines 36. In the embodiment of FIG. 2, the capacitive touch pad sensor IC circuit 32 is marketed as a single unit by Atmel under the trade designation AT42QT2160. The touch pad array 40 is an array of sensing keys, which is normally made of copper patterns on a printed circuit board or other conductive materials. These sensing keys form the touch slider 10 and touch keys 12 (FIG. 1), which are preferably beneath faceplate 11.

The capacitive touch pad sensor IC circuit 32 continuously scans the touch pad array 40 for proximity of a finger (via the data interface lines 36). If proximity is detected, this is transmitted to microcontroller 38 by means of data lines 34. The microcontroller 38 performs a task based on what pad in the touch pad array 40 has been touched. Depending on the task, the microcontroller 38 provides a PWM output signal to LED driver circuit 20 by means of lead 30. The LED driver circuit 20 includes a "buck driver" (to be described) and converts an 110 volt alternating input AC current 22 to low voltage DC output current 24, suitable for driving one or more or an array of LED's.

Also shown in FIG. 2 is lead 26 that provides low voltage DC power from the LED driver circuit 20 to the microcontroller 38 suitable for powering the microcontroller 38. This low voltage DC power is also tapped by the touch pad input sensor 32 by means of lead VDD. Alternatively, an external offline voltage regulator could be used to power the microcontroller 38 and the touch pad input sensor 32. The microcontroller 38 is "field" programmable, such as by the end user, and is marketed by Texas Instruments under the trade designation MSP430, but other suitable low power microcontrollers can be employed.

Instead of a microcontroller, other programmable integrated circuits can be employed, such as a "field" programmable gate array (FPGA), or an application specific integrated circuit (ASIC). In the case of the latter, the circuit is factory programmed. By "factory programmed", it is meant that the circuit is programmed either at the factory or by other than in the "field"; e.g., by other than the end user. An application specific integrated circuit (ASIC) is a circuit that is designed and customized for a specific application. For example, an ASIC designed for the present invention, will solely perform the functions necessary to operate an LED driver as described; as such it cannot be redesigned or reprogrammed to operate a microwave oven. Therefore, such an ASIC will not be considered a standard integrated circuit useful for other tasks.

Figure 3:
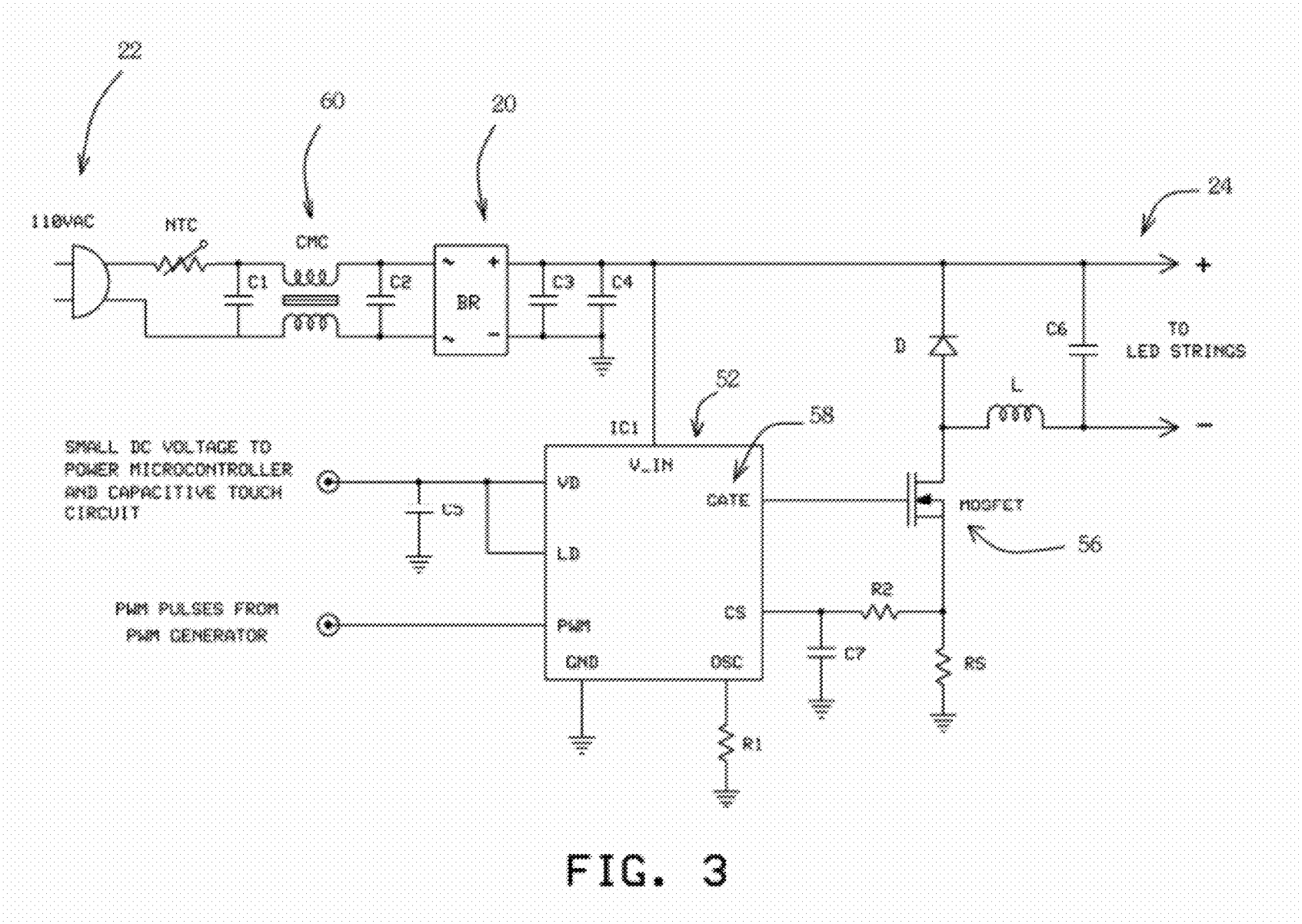
FIG. 3 is a schematic illustration showing details of the LED driver circuit of FIG. 2.

Details of the LED driver circuit 20 are shown in FIG. 3. Transformer 60 converts a 110 v AC current in leads 22 to a high voltage DC current. The LED driver circuit 20 includes an integrated driver control circuit (IC1) 52 marketed by Supertex Inc under the trade designation HV9910. The HV9910 control circuit 52 shown in FIG. 3 is a DC-DC switching converter called a buck-converter. The term "buck" refers to DC-DC switching converters that convert a high DC voltage to a low DC voltage. The operation of the HV9910 control circuit 52 is explained in detail in the HV9910 data sheets, incorporated by reference herein. The HV9910 control circuit 52, among other things, converts the high DC voltage from transformer 60 (pin $V_{in}$) to a low DC voltage (pin $V_D$) that is useful in powering the microcontroller 38 (FIG. 2) and the touch pad input sensor 32, in the manner described above.

There are two methods for dimming LED's: analog; and PWM (pulse width modulation). Analog dimming is achieved by reducing the current in the LED's. PWM dimming is achieved by reducing the duty cycle of the applied PWM current while keeping the current in the LED's at a maximum. Analog dimming in a string of LED's for lighting has a major drawback, namely an LED color shift. Lowering the LED current causes a subtle change in radiant wavelength. As such, PWM dimming is the preferred method of dimming LED's used in the lighting industry because the LED current remains constant as the LED's are dimmed. The present invention employs PWM dimming.

Pulse width modulation (PWM) is the process of switching a DC voltage ON and OFF at a given or fixed frequency, with varying ON and OFF times. These ON and OFF times are referred to as the "duty cycle", which is defined as the ratio of the ON time of the PWM signal to its period (period being the time of one complete cycle). The LED's are dimmed by reducing the duty cycle of the PWM signal in a manner to be described. The more the ON time, or the greater the duty cycle, the brighter the LED's. When the duty cycle is at 1%, the LED's are very dim, and when the duty cycle is more than 99%, the LED's are fully lit. If the frequency of the PWM signal is high enough, the LED's appear at a flicker free brightness to human eyes. As will be described, the PWM signal is applied at a frequency higher than 100 Hz, faster than the eyes can detect.

With reference to FIGS. 2 and 3, the functions of the microcontroller 38 are accomplished by applying a PWM signal from microcontroller 38 (FIG. 2) to the pin "PWM" of the HV9910 control circuit 52 (FIG. 3). Dimming is accomplished by reducing the duty cycle of the applied PWM signal. The HV9910 control circuit 52 provides a low frequency PWM dimming input that can accept an external control signal with a duty ratio of 0-100% and a frequency of up to a few kilohertz.

The HV9910 control circuit 52 controls an external MOSFET transistor 56 via gate 58. The term MOSFET stands for Metal Oxide Semiconductor Field Effect Transistor. It is a sensitive low loss transistor that is used in high speed switching. Conventional transistors dissipate a lot of energy when used as a switch. The dissipation is mainly due to junction resistance and capacitance among other things. MOSFETS have very low ON resistance and capacitance. The gate 58 of HV9910 control circuit 52 can have a fixed switching frequency up to 300 KHz, which is simply set by resistor R1 (FIG. 3). The equation that relates the resistor R1 to the switching frequency is described in the HV9910's data sheet. The microcontroller 38 through the HV99110 control circuit 52 controls the duty ratio of the switching. The inductor L, capacitor C6, and diode D (FIG. 3) form the "buck" regulator. When the "gate" output of the HV9910 is in "ON" state, the so-called "charge cycle" begins: the MOSFET acts like a "closed" switch, and current passes through the inductor L, capacitor C6, and the LED(s). This current also develops a magnetic field in inductor L. During the "charge cycle", no current flows in the diode D since it is reverse-biased. When the gate output of HV9910 is turned off, the so-called "discharge cycle" begins: the MOSFET is turned off and acts as an open switch. At this time, the magnetic field in the inductor L collapses and therefore a current flows through diode D, capacitor C6, and the LED(s). This "charge" and "discharge" cycles continue as the gate 58 of the HV9910 is turned on and off at the switching frequency set by resistor R1.

Other aspects of the LED driver 20 are disclosed in parent application Ser. No. 12/324,200, filed Nov. 11, 2008, incorporated by reference herein.

In the present invention, the touch pad sensors 10 and 12 (FIG. 1) replace a conventional switch such as a simple mechanical momentary push-button switch. Mechanical switches do not last long and eventually break. A critical component of the touch sensor of the present invention is the capacitive touch pad sensor IC circuit 32 (FIG. 2). The capacitive touch pad sensor IC circuit 32 is a smart, non-programmable circuit that repeatedly checks the capacitance of a conductive material used as the touch pad. In operation, if the capacitance increases due to proximity of a finger, the capacitive touch pad sensor IC circuit interprets that as a "closed" state; otherwise, the touch pad is considered to be in an "open" state. The open/close states are transmitted to the microcontroller 38 in a digital format so that the microcontroller 38 becomes informed of the proximity of the finger. The microcontroller 38 is programmed to take action upon the finger proximity. For example, it could toggle a light on/off with every proximity. Or, it could change the duty cycle of the PWM signal if the proximity is maintained for more than three seconds (hence dimming) So, by attaching the capacitive touch pad sensor IC circuit 32 to the microcontroller 38, and by intelligently programming the microcontroller 38, it is very easy to detect the finger proximity to one or more touch pads and take a desired action. The important thing is that the touch sensor IC circuit 32 will reliably detect and report to the microcontroller every, single, finger proximity to any of the touch pads.

By way of example, for dimming, this integrated circuit provides a "slider" control (item 10, FIG. 1) using only four touch pads, such that a finger can actually slide in a linear path of the four pads. The four pads are placed about 1" apart on a line. Sliding a finger in the linear path change the code sent to the microcontroller 38 to a number between 0 and 255. This is transmitted to the microcontroller 38 to set the dimming level in 255 levels (i.e. resolution of 255). Placing the finger on the top of the slider will set the code to 255 (max duty cycle, full brightness), and placing finger on the bottom of the slider will set the code to 0 (min duty cycle, min brightness or off). Other suitable capacitive touch pad sensor IC circuits may be employed for finger proximity sensing. However, the microcontroller 38 may have to be programmed accordingly.

For the automatic scheduled or timed "on/off" function, one or more pads 12 (FIG. 1) may be used. For instance, one pad may be provided so that when touched the LED light(s) will go on for a fixed period. At the end of the period, the LED light(s) will turn off. After that, the LED light(s) will not turn on unless the same pad is touched again. For example, if the fixed period is 9 hours, the first employee that comes to work will turn the light(s) on using this feature. The light(s) will automatically turn off after nine hours or so and no energy will be wasted if an employee forgets to turn off the light(s). Alternatively, this function can be programmed to turn on a light at a predetermined time and then turn it off, again at a predetermined time; or in other ways as desired.

For the random function, one or more pads (12, FIG. 1) correspond to a certain random duration for on/off. One pad is used for random events that have periods of, for example, one to five hours. One pad could be used for random events that have random periods of, for example, 10 to 20 hours, etc. In general, one pad may be sufficient for this function.

One advantage of the present invention is that by using a touch sensor as the face plate for an ordinary 110 volt outlet box, the outlet box is provided with additional space for the other components of the LED driver of the present invention.

From the above description of the present invention, those skilled in the art may perceive improvements, modifications and changes. Such improvements, modifications, and changes within the skill of the art are intended to be covered by the claims appended hereto.

What is claimed is:

1. A programmable LED driver comprising;

a. an LED driver circuit adapted to receive a 110VAC current and to rectify said AC current into a low voltage rectified DC output current;

b. a programmable integrated circuit (PIC);

c. means operatively connecting said programmable integrated circuit with said LED driver circuit;

d. a capacitive touch pad sensor comprising a plurality of touch pads;

e. a capacitive touch pad sensor IC circuit that scans one or more of the touch pads to provide corresponding data to said programmable integrated circuit;

f. said programmable integrated circuit being programmable to accept said data as input and generate an output signal to said LED driver circuit corresponding to said data; and g. one or more of said touch pads functioning for dimming such that said programmable integrated circuit r generates a fixed frequency PWM signal having an adjustable duty cycle for dimming said LED's h. said means of paragraph c. providing a low voltage DC current to said programmable integrated circuit and to said capacitive touch pad sensor, said LED driver being adapted to fit within a standard 110 volt AC outlet box.

2. The LED driver of claim 1 wherein the touch pad for dimming is a touch slider.

3. The LED driver of claim 2 wherein said programmable integrated circuit is a microcontroller.

4. A programmable LED driver comprising;

a. an LED driver circuit adapted to receive a 110VAC current and to rectify said AC current into a low voltage rectified DC output current;

b. a programmable integrated circuit (PIC);

c. means operatively connecting said programmable integrated circuit with said LED driver circuit;

d. a capacitive touch pad sensor comprising a plurality of touch pads;

e. a capacitive touch pad sensor IC circuit that scans one or more of the touch pads to and provides corresponding data to said programmable integrated circuit;

f. said programmable integrated circuit being programmable to accept said data as input and generate an output signal to said LED driver circuit corresponding to said data; and g. said means of paragraph c. providing a low voltage DC current to said programmable integrated circuit and to said capacitive touch pad sensor, said driver being adapted to fit within a 110 volt AC outlet box, said touch pad sensor being the faceplate of the outlet box.

5. The driver of claim 4 adapted to control an array of LED's.

6. A programmable LED driver comprising;

a. an LED driver circuit adapted to receive a 110VAC current and to rectify said AC current into a low voltage rectified DC output current;

b. a programmable integrated circuit (PIC);

c. means operatively connecting said programmable integrated circuit with said LED driver circuit;

d. a capacitive touch pad sensor comprising a plurality of touch pads;

e. a capacitive touch pad sensor IC circuit that scans one or more of the touch pads and provides corresponding data to said programmable integrated circuit;

f. said programmable integrated circuit being programmable to accept said data as input and generate an output signal to said LED driver circuit corresponding to said data;

g. one or more of said touch pads functioning for dimming such that said programmable integrated circuit generates a fixed frequency PWM signal having an adjustable duty cycle for dimming said LED's;

h. one or more of said touch pads functioning for timed on/off function such that said programmable integrated circuit enables/disables said PWM signal to automatically turn on/off said LED's; and i. one or more touch pads functioning for random on/off function such that said programmable integrated circuit randomly enables/disables said PWM signal to randomly turn on/off said LED's.

7. The LED driver of claim 6 wherein said programmable integrated circuit is a field programmable integrated circuit.

8. The LED driver of claim 6 wherein said programmable integrated circuit is a microcontroller.

9. The LED driver of claim 6 wherein said programmable integrated circuit is an application specific integrated circuit and said application specific integrated circuit is factory programmed.

10. The LED driver of claim 6 adapted to fit within a 110 V AC outlet.

* * * * *